US010617235B2

(12) United States Patent
Tran

(10) Patent No.: US 10,617,235 B2
(45) Date of Patent: Apr. 14, 2020

(54) FOOTWEAR STORAGE AND DISPLAY RACK

(71) Applicant: Williams-Sonoma, Inc., San Francisco, CA (US)

(72) Inventor: Dan Tran, San Francisco, CA (US)

(73) Assignee: Willams-Sonoma, Inc., San Francisco, CA (US)

( * ) Notice: Subject to any disclaimer, the term of this patent is extended or adjusted under 35 U.S.C. 154(b) by 0 days.

(21) Appl. No.: 16/126,544

(22) Filed: Sep. 10, 2018

(65) Prior Publication Data

US 2019/0075946 A1 Mar. 14, 2019

Related U.S. Application Data

(60) Provisional application No. 62/556,878, filed on Sep. 11, 2017.

(51) Int. Cl.
*A47F 7/08* (2006.01)
*A47F 5/08* (2006.01)
(Continued)

(52) U.S. Cl.
CPC ..... *A47F 7/08* (2013.01); *A47B 61/04* (2013.01); *A47B 96/025* (2013.01); *A47B 96/027* (2013.01); *A47F 5/0043* (2013.01); *A47F 5/0853* (2013.01); *A47F 5/10* (2013.01); *A47F 5/12* (2013.01); *A47F 5/16* (2013.01); *A47F 7/0021* (2013.01); *A47F 5/0018* (2013.01);
(Continued)

(58) Field of Classification Search
CPC ..... A47F 7/08; A47F 5/0853; A47F 5/0018; A47F 7/06; A47F 5/0869; A47F 5/10; A47F 5/12; A47F 5/16; A47F 5/08; A47F 7/0021; A47F 5/0043; A47F 2005/165; A47B 61/04; A47B 45/00; A47B 47/022; A47B 96/027; A47B 96/07; A47B 96/025; A47B 96/02; A47G 25/10; A63B 47/00; A63B 2225/09; A63B 71/0045; A47L 23/20; A63D 15/10
USPC ..... 211/35, 14, 34, 36, 37, 38, 87.01, 88.01, 211/90.01, 90.02, 175, 26.2; 248/200, 248/244, 247, 295.11, 298.1
See application file for complete search history.

(56) References Cited

U.S. PATENT DOCUMENTS 320,057 A * 6/1885 Freaner et al. ..... A47F 5/01 211/106
620,658 A * 3/1899 Kirtland ..... A47L 23/18 15/267
(Continued)

*Primary Examiner* — Jennifer E. Novosad
(74) *Attorney, Agent, or Firm* — Cook Alex Ltd.; R. Blake Johnston

(57) ABSTRACT

A footwear storage and display rack includes a mounting member configured to be mounted to a wall or other generally vertical surface. The mounting member includes an upper portion and a lower portion. A footwear shelf includes a proximal section and a distal section with the proximal section extending from the lower portion of the mounting member so as to be configured at an angle between about 0 degrees and about 90 degrees with respect to the wall or other generally vertical surface when the mounting member is secured to the wall or other generally vertical surface. The distal section extends from the proximal section. An accessory support extends from the upper portion of the mounting member.

17 Claims, 8 Drawing Sheets

(51) Int. Cl.

| | |
|---|---|
| ***A47F 7/00*** | (2006.01) |
| ***A47F 5/00*** | (2006.01) |
| ***A47F 5/16*** | (2006.01) |
| ***A47B 61/04*** | (2006.01) |
| ***A47F 5/10*** | (2006.01) |
| ***A47B 96/02*** | (2006.01) |
| ***A47F 5/12*** | (2006.01) |
| ***A47G 25/10*** | (2006.01) |
| ***A63D 15/10*** | (2006.01) |
| ***A63B 71/00*** | (2006.01) |
| ***A63B 47/00*** | (2006.01) |

(52) U.S. Cl.
CPC ..... *A47F 2005/165* (2013.01); *A47G 25/10* (2013.01); *A63B 47/00* (2013.01); *A63B 71/0045* (2013.01); *A63B 2225/09* (2013.01); *A63D 15/10* (2013.01)

(56) References Cited

U.S. PATENT DOCUMENTS 694,694 A * 3/1902 Sweet ..... A47F 7/08 211/37
811,335 A * 1/1906 Spangenberg ..... B60J 3/0217 248/289.11
1,029,390 A * 6/1912 Milewski ..... F16M 13/02 248/287.1
1,238,275 A * 8/1917 Deeley ..... A47F 7/08 211/36
1,416,823 A * 5/1922 Hecht ..... A47F 7/08 211/34
1,631,355 A * 6/1927 Baldwin ..... A47B 29/00 248/316.6
1,821,024 A * 9/1931 Noble ..... A47F 7/08 211/34
1,848,890 A * 3/1932 Kennedy ..... A47F 5/10 312/118
1,944,649 A * 1/1934 Smith, Sr. ..... A47F 7/08 211/37
1,949,017 A * 2/1934 Knupp ..... A47F 7/08 211/35
2,270,796 A * 1/1942 Hauser ..... A47G 25/08 211/119.004
2,324,655 A * 7/1943 Tozer ..... B67C 11/00 248/94
2,530,537 A * 11/1950 Persinger ..... A47L 23/18 12/53.7
2,541,434 A * 2/1951 Nelson ..... E06C 7/14 248/210
2,586,665 A * 2/1952 Konikoff ..... A47F 7/08 211/37
2,681,194 A * 6/1954 Halvorsen ..... A47G 1/1626 248/495
2,710,051 A * 6/1955 Greenberg ..... A47C 7/70 108/6
2,886,182 A * 5/1959 Dauman ..... A47F 5/005 211/55
2,982,508 A * 5/1961 Larsen ..... A47B 57/565 248/205.1
3,870,153 A * 3/1975 Allsop ..... A47F 5/02 211/37
4,122,954 A * 10/1978 Slater ..... A47F 3/14 108/6
4,179,091 A * 12/1979 Bidney ..... A47H 1/144 248/265
4,192,424 A * 3/1980 Allsop ..... A47B 57/567 211/37
4,659,044 A * 4/1987 Armstrong ..... F16M 13/02 114/343
4,693,380 A * 9/1987 Muth ..... A47B 96/061 108/46
D307,286 S * 4/1990 Ginder ..... 248/200
4,934,642 A * 6/1990 Baron ..... A47B 96/065 108/108
4,949,929 A * 8/1990 Kesselman ..... A47B 96/06 248/220.1
5,085,327 A * 2/1992 Mercer, Jr. ..... A63B 71/0045 211/85.7
5,137,240 A * 8/1992 Van Meter ..... A47G 25/845 211/35
5,413,228 A * 5/1995 Le Clerc ..... A47G 1/0616 211/13.1
5,547,157 A * 8/1996 Hsiao ..... A63C 17/00 211/35
5,580,024 A * 12/1996 Briee ..... A47B 23/043 248/444
5,662,301 A * 9/1997 Fard ..... A47F 7/08 211/34
5,685,121 A * 11/1997 DeFrancesco ..... E04C 3/07 52/241
5,813,583 A * 9/1998 Benedeti ..... B60R 11/0211 108/45
5,871,192 A * 2/1999 Horwitz ..... A47G 29/00 248/274.1
5,884,876 A * 3/1999 Axford ..... E04D 13/0722 248/48.1
5,992,648 A * 11/1999 Saunders ..... A47F 5/0846 211/35
6,019,326 A * 2/2000 Baerwolf ..... F16M 11/045 248/177.1
6,131,981 A * 10/2000 Finley ..... B60R 9/00 211/187
6,273,382 B1 * 8/2001 Pemberton ..... A47B 21/0314 248/118.1
6,349,911 B1 * 2/2002 Feldpausch ..... A47B 57/34 211/90.02
6,364,136 B1 * 4/2002 Weshler ..... A47B 96/025 108/102
6,398,174 B1 * 6/2002 Emalfarb ..... A47G 7/044 248/214
6,402,111 B1 * 6/2002 Stewart ..... A47B 21/0314 248/295.11
6,637,608 B1 * 10/2003 Schneider ..... A47B 45/00 211/175
6,662,499 B1 * 12/2003 Shin ..... F16M 13/02 248/298.1
7,137,227 B2 * 11/2006 Franz ..... E04B 1/38 52/243.1
7,240,707 B1 * 7/2007 Schweitzer ..... B25H 1/10 144/286.5
7,686,273 B2 * 3/2010 Christodoulou ..... A47G 1/202 248/295.11
7,722,003 B2 * 5/2010 Ishizaki ..... F16M 11/105 248/125.1
7,992,833 B1 * 8/2011 Goodman ..... A47G 25/0614 248/298.1
8,839,575 B1 * 9/2014 Liu ..... H02S 20/23 52/173.3
9,126,328 B2 * 9/2015 Brandeis ..... A45F 5/02
10,323,414 B2 * 6/2019 Haba ..... E04B 1/40
2003/0019991 A1 * 1/2003 Carlsson ..... B60N 3/102 248/311.2
2004/0262247 A1 * 12/2004 Moon ..... A47F 3/002 211/74
2006/0118685 A1 * 6/2006 Schluter ..... H05K 7/1448 248/244
2008/0135701 A1 * 6/2008 Smith ..... E04F 21/1855 248/207
2009/0045707 A1 * 2/2009 Gerstner ..... A47F 3/14 312/234
2009/0065454 A1 * 3/2009 Scholen ..... A47F 5/0087 211/35
2009/0184067 A1 * 7/2009 McAdory ..... B60R 7/10 211/35
2012/0068027 A1 * 3/2012 Tyner ..... A47F 1/04 248/201

* cited by examiner

FOOTWEAR STORAGE AND DISPLAY RACK

CLAIM OF PRIORITY

This application claims the benefit of U.S. Provisional Application No. 62/556,878, filed Sep. 11, 2017, the contents of which are hereby incorporated by reference.

FIELD OF THE INVENTION

The present disclosure relates generally to footwear storage devices and, in particular, to a footwear storage and display rack that also accommodates one or more related accessories.

BACKGROUND

Athletic shoes are often used with additional apparel items or equipment. For example, an individual playing basketball uses a basketball and typically wears basketball shoes. As another example, an individual playing baseball uses a baseball and may wear a baseball cap and baseball shoes. A shoe storage device that also stores associated apparel and/or equipment would make access easier and also reduce the chances that the item of apparel or piece of equipment is lost. In addition, an individual may wish to store the items together for decorative display purposes, such as a pair of basketball shoes displayed with a basketball or a pair of baseball shoes displayed with a baseball or cap of the owner's favorite team. Such a storage and display device could find use in a retail environment as well.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a footwear storage and display rack includes a mounting member configured to be mounted to a wall or other generally vertical surface. The mounting member includes an upper portion and a lower portion. A footwear shelf includes a proximal section and a distal section with the proximal section extending from the lower portion of the mounting member so as to be configured at an angle between about 0 degrees and about 90 degrees with respect to the wall or other generally vertical surface when the mounting member is secured to the wall or other generally vertical surface. The distal section is movable with respect to the proximal section so that a length of the footwear shelf is adjustable. An accessory support extends from the upper portion of the mounting member.

In another aspect, a footwear storage and display rack includes a mounting member configured to be mounted to a wall or other generally vertical surface. The mounting member includes an upper portion and a lower portion. A footwear shelf includes a proximal section and a distal section with the proximal section extending from the lower portion of the mounting member so as to be configured at an angle between about 0 degrees and about 90 degrees with respect to the wall or other generally vertical surface when the mounting member is secured to the wall or other generally vertical surface. The distal section extends from the proximal section. An accessory support extends from the upper portion of the mounting member.

DETAILED DESCRIPTION OF EMBODIMENTS

An embodiment of the footwear storage and display rack of the invention is indicated in general at 10 in FIGS. 1A-4. The rack includes a mounting member 12 that may be mounted to a wall or other generally vertical surface. More specifically, the mounting member 12 may be planar and may include apertures, indicated at 14*a* and 14*b* in FIG. 3, that receive fasteners, such as screws or nails, that engage the wall or other surface. Adhesive or other wall fastening arrangements known in the art may be used instead so that the apertures 14*a* and 14*b* (FIG. 3) may optionally be omitted. As another alternative, a single aperture and fastener may be used. In addition, the mounting member 12 does not have to be planar, but may instead be another configuration with a surface that is configured to engage the surface of a wall or other support.

Figure 1A:
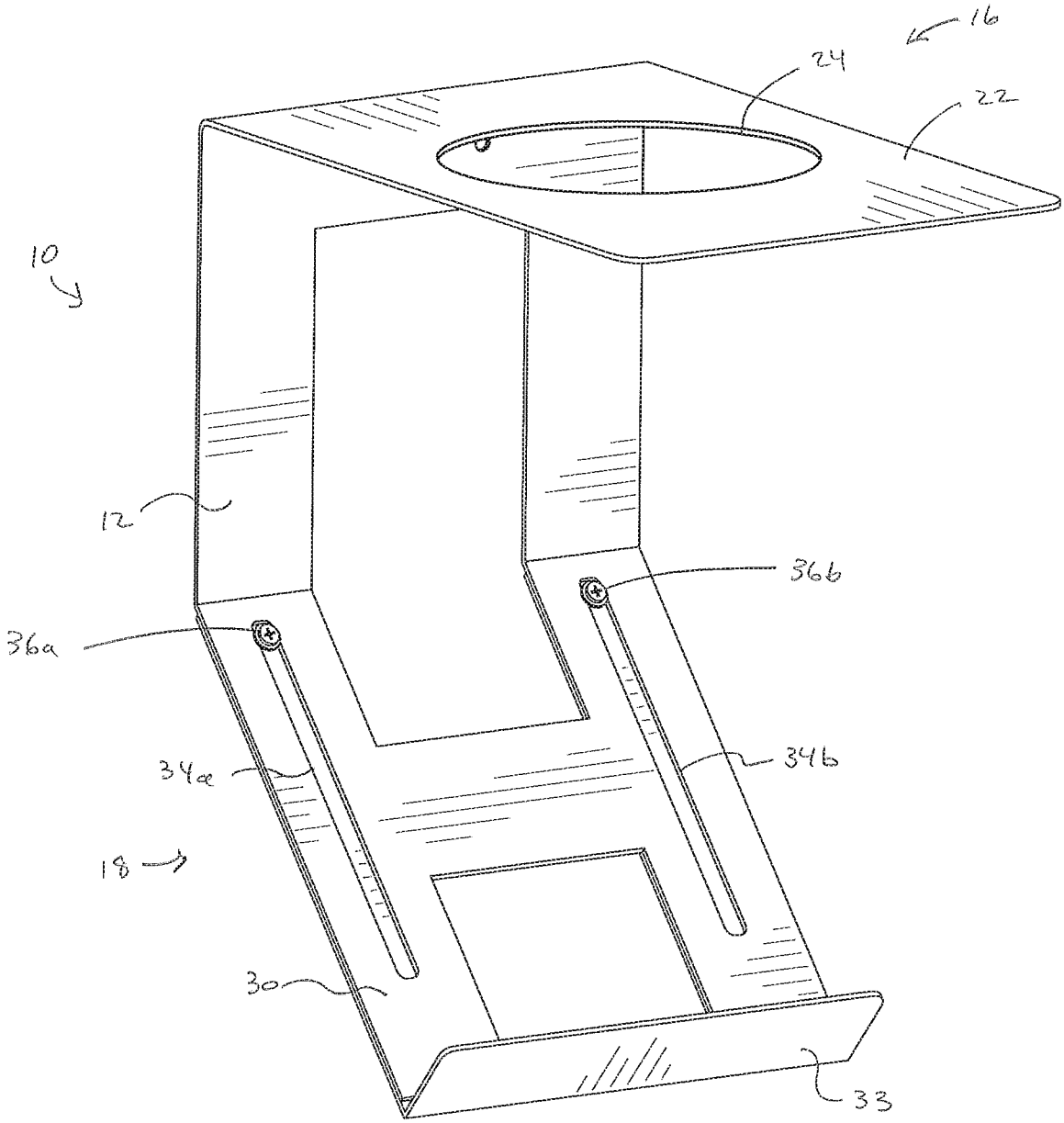
FIG. 1A is a perspective view of the footwear rack of the disclosure with the footwear shelf in a first configuration.
Figure 4:
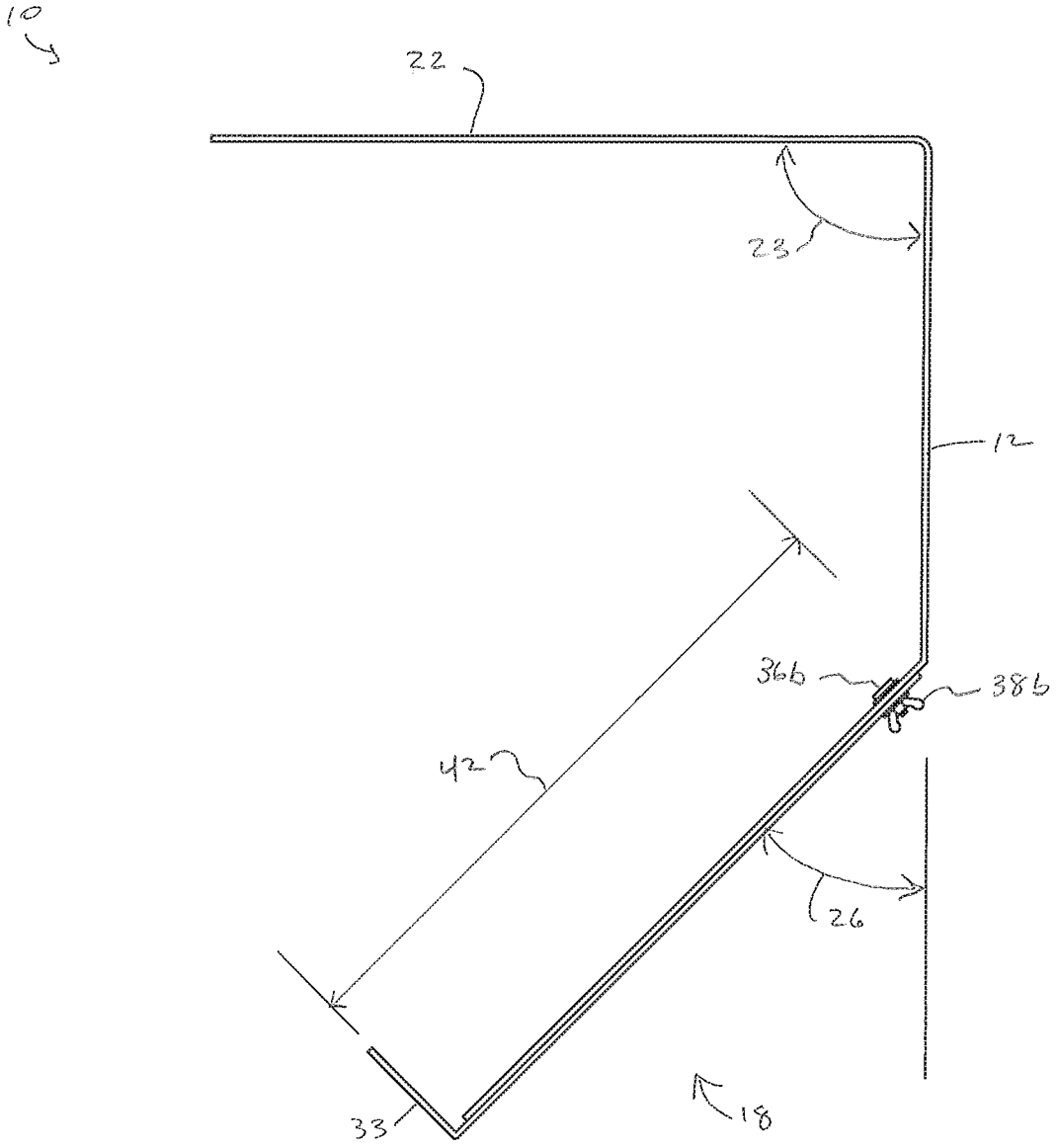
FIG. 4 is a side end elevational view of the footwear rack of FIG. 1A.
Figure 5A:
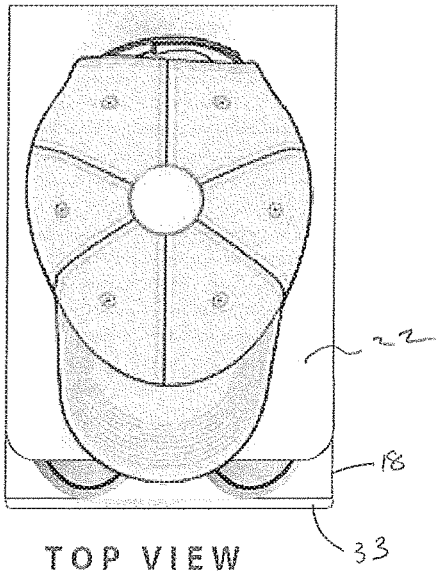
FIG. 5A is a top plan view of an embodiment of the footwear rack of the disclosure holding a pair of shoes and a ball cap.
Figure 5B:
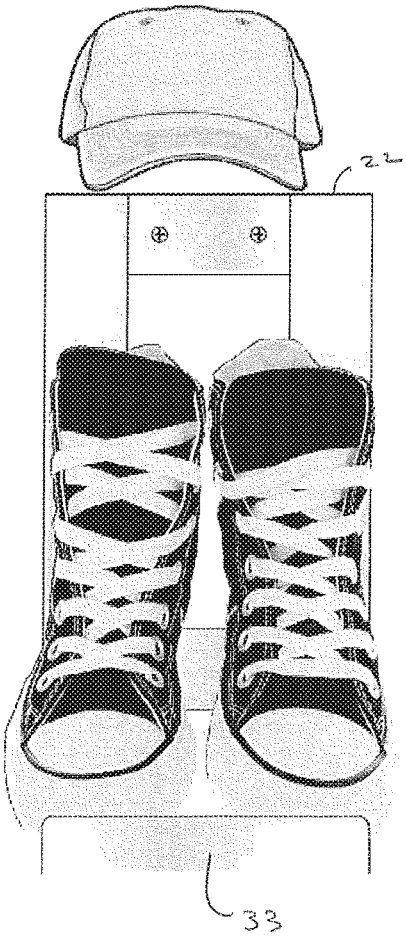
FIG. 5B is a front elevational view of the embodiment of the footwear rack of FIG. 5A.
Figure 5C:
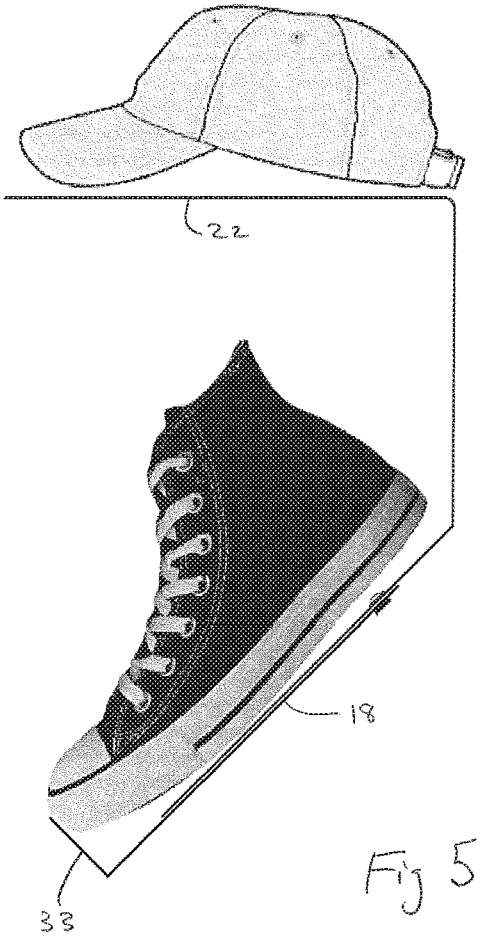
FIG. 5C is a side elevational view of the embodiment of the footwear rack of FIGS. 5A and 5B.
Figure 6A:
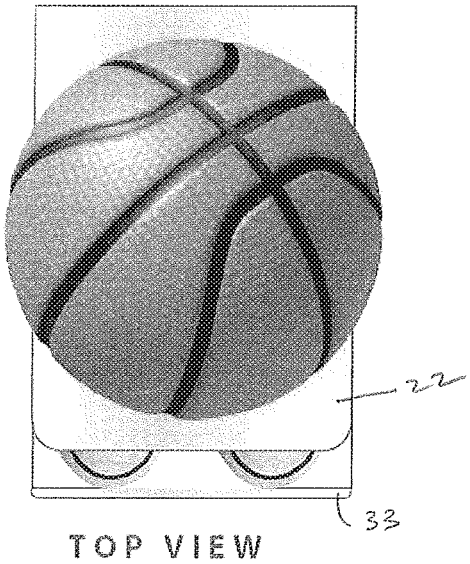
FIG. 6A is a top plan elevational view of an embodiment of the footwear rack of the disclosure holding a pair of shoes and a basketball.
Figure 6B:
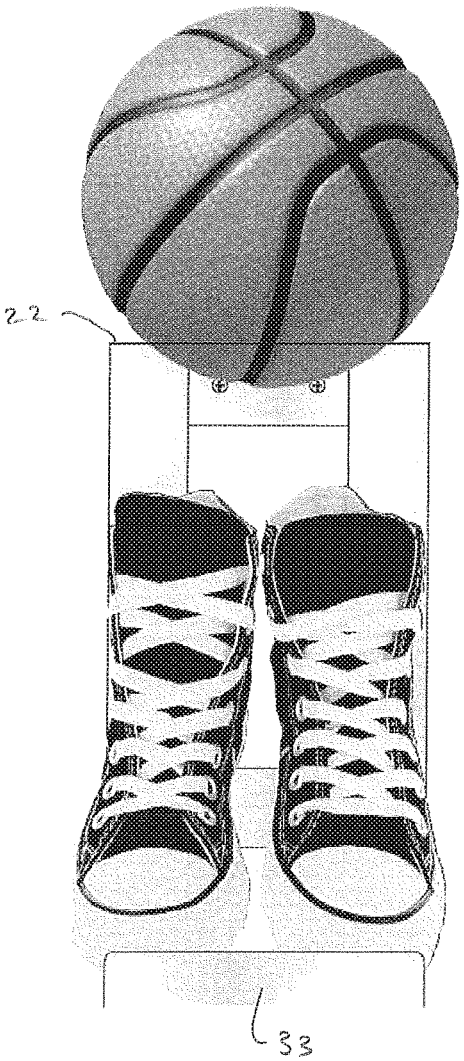
FIG. 6B is a front elevational view of the embodiment of the footwear rack of FIG. 6A.
Figure 6C:
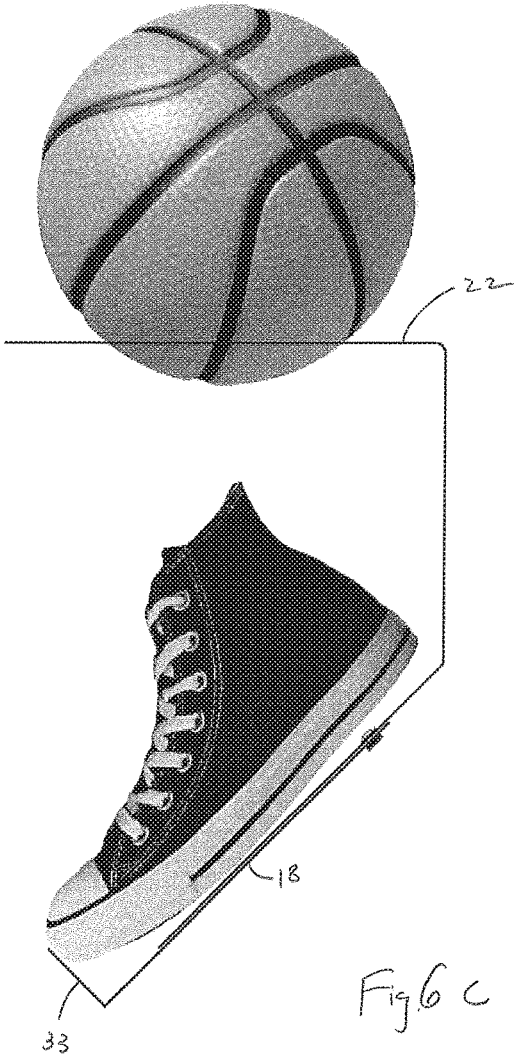
FIG. 6C is a top plan of the embodiment of the footwear rack of FIGS. 6A and 6B.

An accessory support, indicated in general at 16 in FIG. 1A, extends from an upper portion of the mounting member 12, and is configured to support an item of apparel or piece of sports equipment. As an example only, the accessory support may take the form of a panel 22 that extends from the top portion of the mounting member at an angle (23 in FIG. 4) of approximately 90 degrees so as to be generally horizontal. The accessory support may include a circular opening 24 sized to cradle the lower portion of a ball or the like (as illustrated in FIGS. 6A-6C). A cap may alternatively be placed on the accessory support, as illustrated in FIGS. 5A-5C.

While an opening sized to cradle a basketball is shown at 24 for the accessory support 16, the opening may alternatively be sized to cradle the bottom portion of a baseball. Alternatively, the panel 22 may be provided with several smaller openings so that a number of baseballs or golf balls may be held. As another alternative, the opening 24 may feature a different shape, or it may be eliminated entirely.

While the accessory support 16 is illustrated as a generally horizontal panel, to may instead take the form of a bracket or any other structure configured to support an accessory or clothing article. Examples include, but are not limited to, pegs to hold one or more caps, a ball holder or a bracket to hold a golf club, pool cue, rifle or fishing pole.

A footwear shelf, indicated in general at 18 in FIGS. 1A-4, extends from a lower portion of the mounting member 12 in a tilted fashion, such as at an angle (26 of FIG. 4) between 0 degrees and 90 degrees with the supporting wall or other surface.

Figure 1B:
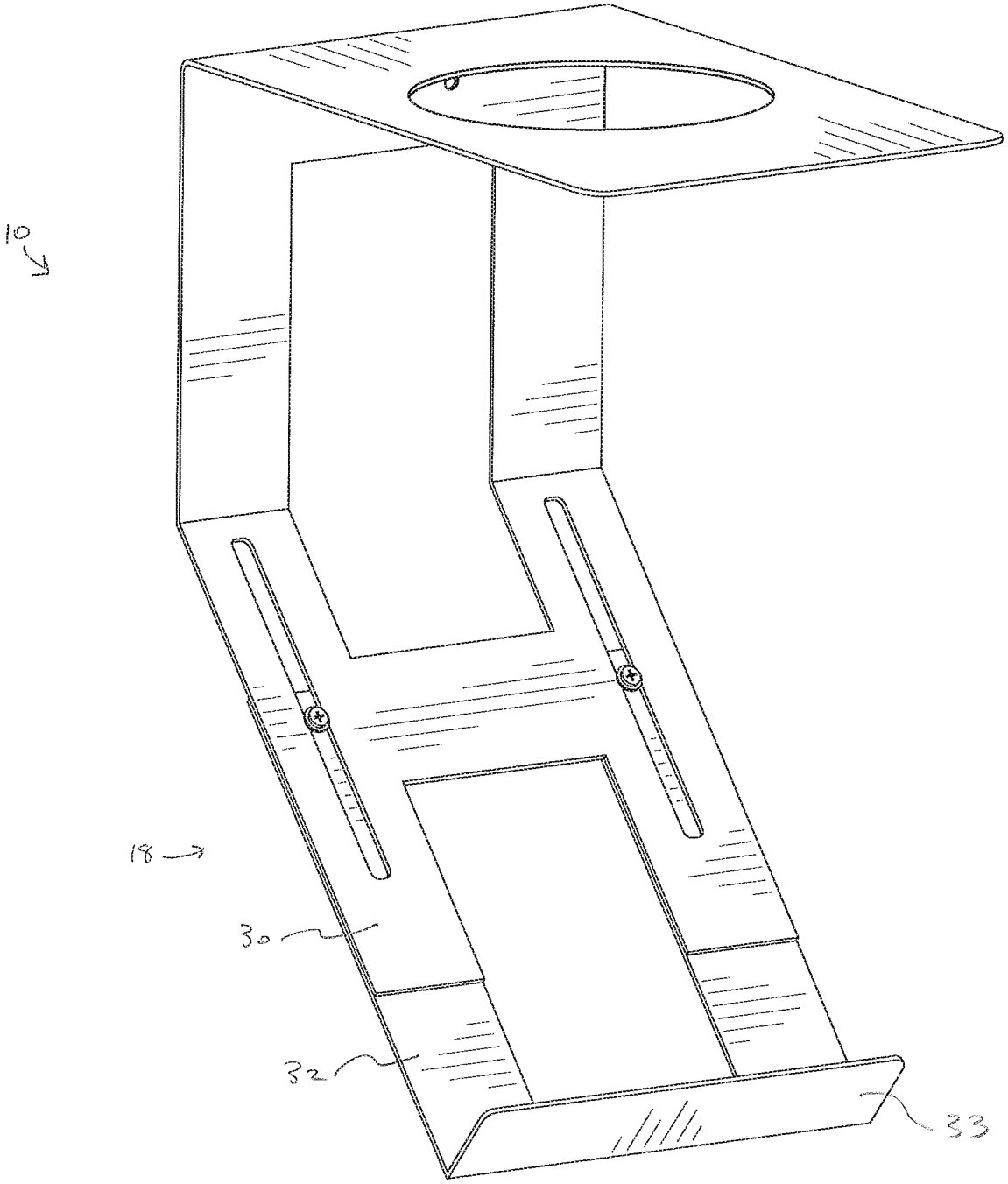
FIG. 1B is a perspective view of the footwear rack of the disclosure with the footwear shelf in a second configuration.
Figure 1C:
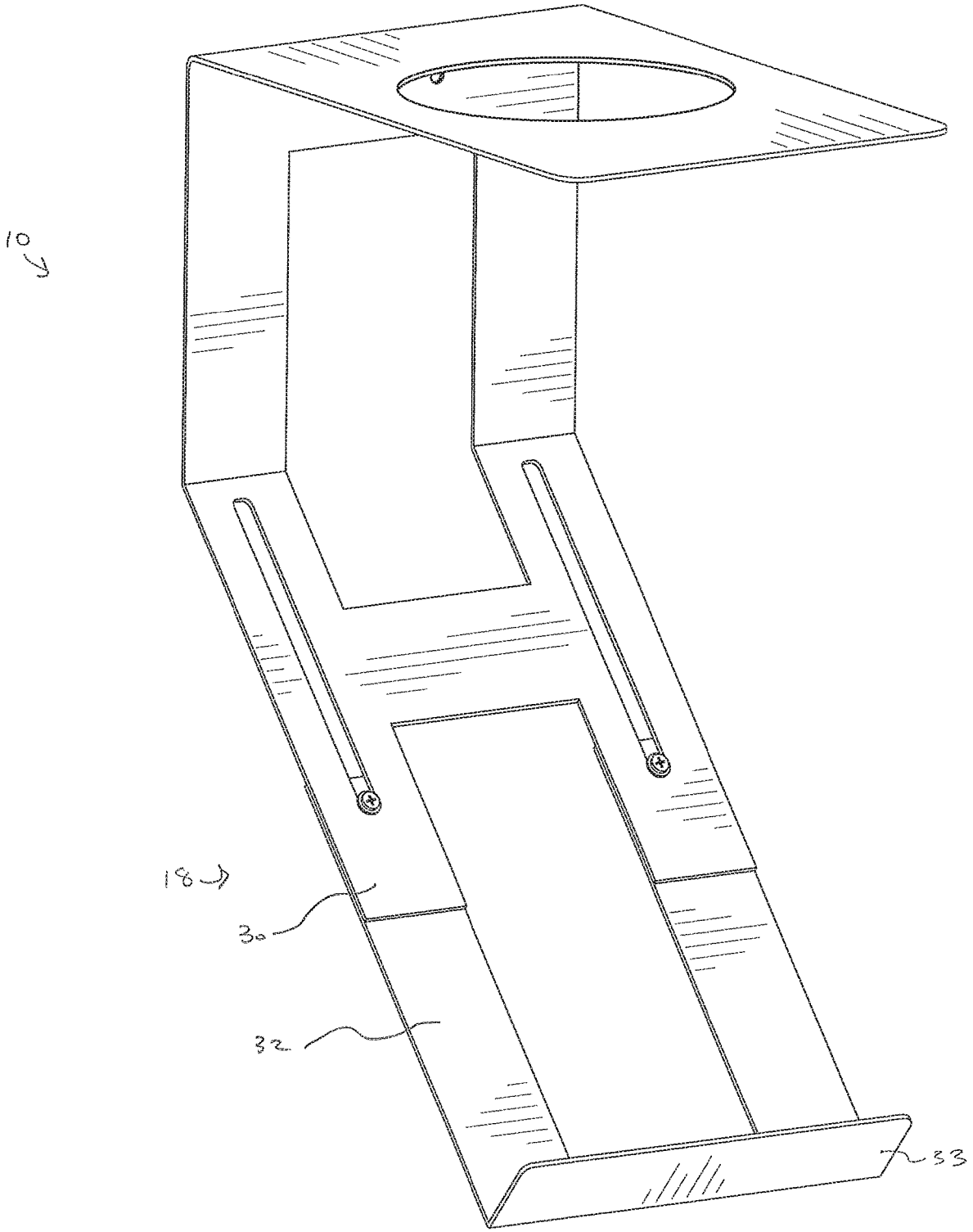
FIG. 1C is a perspective view of the footwear rack of the disclosure with the footwear shelf in a third configuration.
Figure 2:
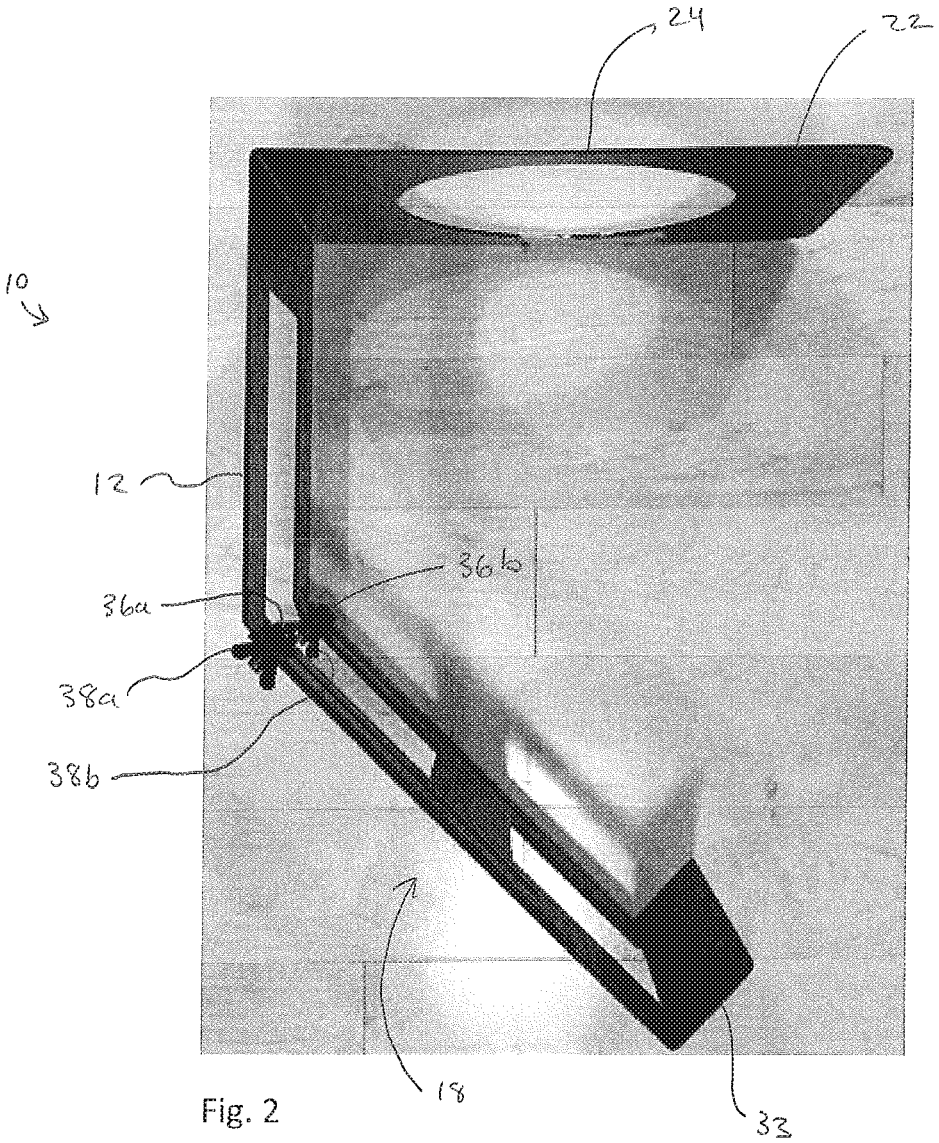
FIG. 2 is a side perspective of the footwear rack of FIG. 1A.
Figure 3:
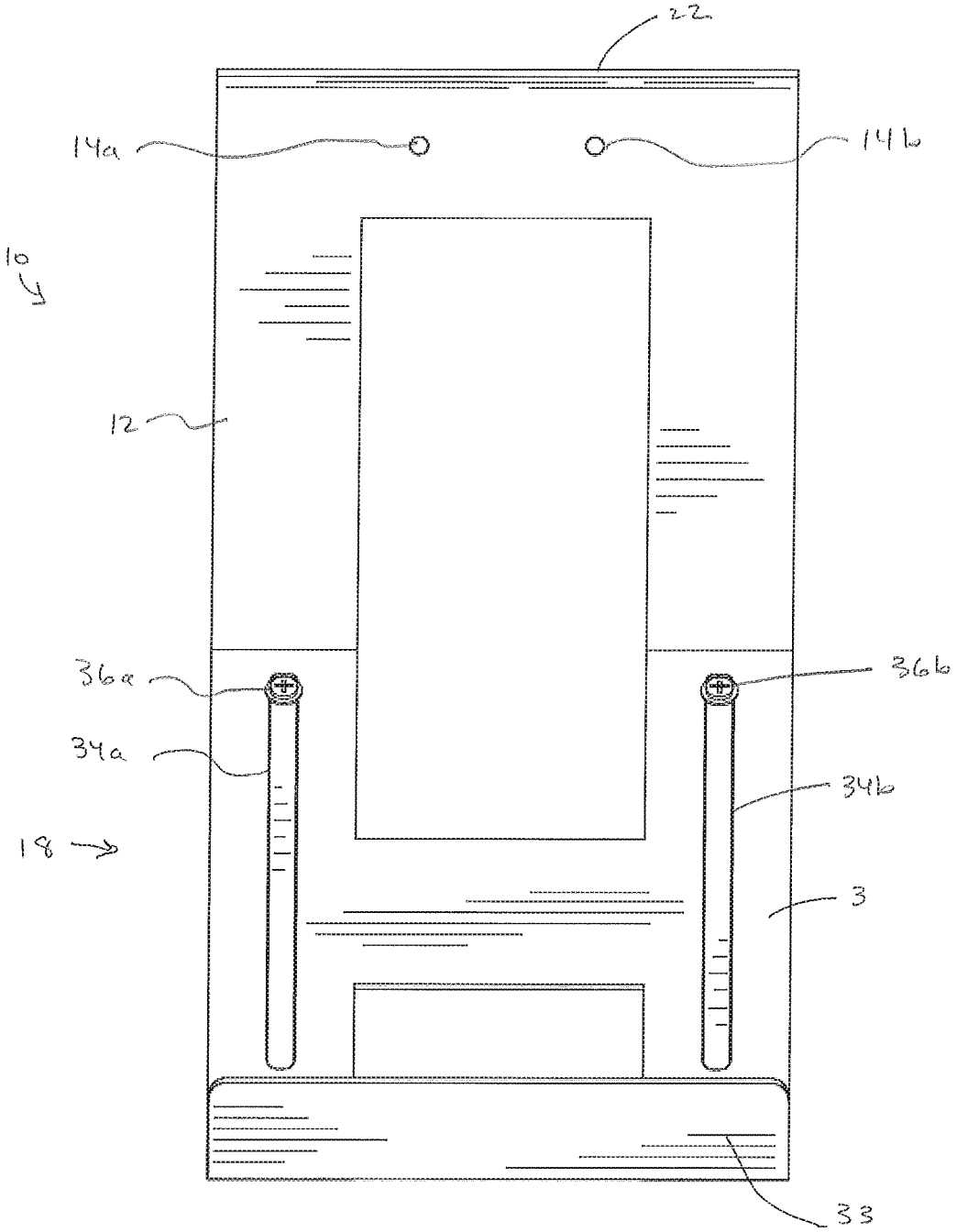
FIG. 3 is a front elevational view of the footwear rack of FIG. 1A.

The footwear shelf includes a proximal section 30 and a distal section 32. The distal section is provided with an upturned retaining lip 33. The proximal section 30 is provided with a pair of elongated slots 34*a* and 34*b*, while the distal section is provided with a pair of apertures that receive fasteners such as screws 36*a* and 36*b* (FIGS. 1A-1C) upon which are mounted nuts 38*a* and 38*b* (FIGS. 2 and 4). When the nuts 38*a* and 38*b* are loosened, the screws 36*a* and 36*b* are free to traverse their corresponding slots so that the distal section 32 may be slid along the proximal section, as illustrated in FIGS. 1A-1C. As a result, the length (indicated at 42 in FIG. 4) of the footwear shelf 18 may be adjusted to accommodate different shoe sizes. When the desired length is selected, the nuts 38*a* and 38*b* are tightened to secure or lock the proximal and distal sections of the footwear shelf in the desired configuration. As a result, a pair of shoes, or other footwear item, may be supported on the footwear shelf 18, as illustrated in FIGS. 5A-6C.

As illustrated in the embodiment described above, the mounting member 12, accessory support 16 and the proximal portion 30 of the footwear shelf could be formed from a single metal panel that is cut and bent to form the three portions of the rack 10. They alternatively may be separately formed and then joined together.

It should be noted that the slots could instead be formed in the distal section 32, with the screws 36*a* and 36*b* and nuts 38*a* and 38*b* mounted in the proximal section. Furthermore, the elongated slots 34*a* and 34*b* and screws 36*a* and 36*b* (with nuts) may be replaced with a single slot and screw (with nut). In addition, other sliding arrangements know in the art could be used, such as channels on one section receiving the edges or a track on the other section. As another alternative, the sliding arrangement between the proximal and distal sections of the footwear shelf could be replaced with an arrangement where the position of the distal section could be adjusted with respect to the proximal section in a non-continuous fashion, such as with tabs or hooks on one section engaging a series of notches on the other section, to adjust the length of the footwear shelf.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A footwear storage and display rack comprising:

a. a mounting member configured to be mounted to a wall or other generally vertical surface, said mounting member including an upper portion and a lower portion;

b. a footwear shelf including a proximal section and a distal section with the proximal section extending from the lower portion of the mounting member so as to be configured at an angle between about 0 degrees and about 90 degrees with respect to the wall or other generally vertical surface when the mounting member is secured to the wall or other generally vertical surface, and the distal section movable with respect to the proximal section so that a length of the footwear shelf is adjustable;

c. an accessory support including a panel extending from the upper portion of the mounting member at an angle of approximately 90 degrees with respect to the wall or other generally vertical surface when the mounting member is secured to the wall or other generally vertical surface.

2. The footwear storage and display rack of claim 1 wherein the distal section of the footwear shelf is slidably mounted to the proximal section.

3. The footwear storage and display rack of claim 2 wherein the proximal section of the footwear shelf includes a slot and the distal section includes a fastener configured to traverse the slot.

4. The footwear storage and display rack of claim 3 wherein the fastener includes a screw and a nut.

5. The footwear storage and display rack of claim 1 wherein the distal section of the footwear shelf includes a retaining lip.

6. The footwear storage and display rack of claim 1 wherein the mounting member, accessory support and the proximal section of the footwear shelf are formed from a single plate of material.

7. The footwear storage and display rack of claim 1 further comprising an opening formed in the panel, said opening sized to cradle a sports ball.

8. The footwear storage and display rack of claim 1 wherein the mounting member is planar.

9. A footwear storage and display rack comprising:

a. a mounting member configured to be mounted to a wall or other generally vertical surface, said mounting member including an upper portion and a lower portion;

b. a footwear shelf including a proximal section and a distal section with the proximal section extending from the lower portion of the mounting member so as to be configured at an angle between about 0 degrees and about 90 degrees with respect to the wall or other generally vertical surface when the mounting member is secured to the wall or other generally vertical surface and the distal section extending from the proximal section;

c. an accessory support extending from the upper portion of the mounting member;

d. wherein the mounting member, accessory support and the proximal section of the footwear shelf are formed from a single plate of material.

10. The footwear storage and display rack of claim 9 wherein the distal section of the footwear shelf is slidably mounted to the proximal section.

11. The footwear storage and display rack of claim 10 wherein the proximal section of the footwear shelf includes a slot and the distal section includes a fastener configured to traverse the slot.

12. The footwear storage and display rack of claim 11 wherein the fastener includes a screw and a nut.

13. The footwear storage and display rack of claim 9 wherein the distal section of the footwear shelf includes a retaining lip.

14. The footwear storage and display rack of claim 9 wherein the accessory support includes a panel.

15. The footwear storage and display rack of claim 14 wherein the panel extends from the upper portion of the mounting member at an angle of approximately 90 degrees with respect to the wall or other generally vertical surface when the mounting member is secured to the wall or other generally vertical surface.

16. The footwear storage and display rack of claim 15 further comprising an opening formed in the panel, said opening sized to cradle a sports ball.

17. The footwear storage and display rack of claim 14 wherein the mounting member is planar and the panel extends from the upper portion of the mounting member at an angle of approximately 90 degrees with respect to the mounting member.

* * * * *